United States Patent [19]
Kunz
[11] 4,318,199
[45] Mar. 9, 1982

[54] MACHINE FOR BURRING AND CLEANING OF SUBSTANTIALLY PLANE WORK PIECES

[75] Inventor: Wolfgang Kunz, Lörrach-Hauingen, Fed. Rep. of Germany

[73] Assignee: Kunz Maschinen-und Apparatebau GmbH, Fed. Rep. of Germany

[21] Appl. No.: 131,397

[22] Filed: Mar. 18, 1980

[30] Foreign Application Priority Data

Mar. 22, 1980 [DE] Fed. Rep. of Germany ..... 2911322

[51] Int. Cl.[3] ..... A46B 13/02
[52] U.S. Cl. ..... 15/77; 51/23
[58] Field of Search ..... 15/77, 102; 51/23; 29/81 H, DIG. 7

[56] References Cited

U.S. PATENT DOCUMENTS

| | | | |
|---|---|---|---|
| 837,375 | 12/1906 | Baird | 15/102 |
| 1,610,374 | 12/1926 | Heichert et al. | 15/77 X |
| 1,817,332 | 8/1931 | Worrall | 15/77 |
| 1,937,258 | 11/1933 | Vogt | 15/77 |
| 2,282,628 | 5/1942 | Whann et al. | 15/77 X |
| 2,617,223 | 11/1952 | McElroy et al. | 15/77 X |
| 3,449,781 | 6/1969 | French et al. | 15/77 |
| 3,566,429 | 3/1971 | Hamilton | 15/77 |

*Primary Examiner*—Edward L. Roberts
*Attorney, Agent, or Firm*—Ratner & Prestia

[57] ABSTRACT

For burring and cleaning operations of substantially plane work pieces such as metal sheets having arbitrarily formed contours, openings and/or apertures and recesses, a machine is being disclosed which is provided at least with one pair of upper and lower driven rotary brushes along the conveying path of the work pieces. The rotary brushes are equipped with twisted or tressed bristles and are arranged with their horizontal axis of rotation at a corresponding inclination with respect to the conveying direction of the work pieces whereby the bristles of the two rotary brushes are meshing in the manner of interengaging gears. The work pieces are thusly burred and cleaned with a single passage through such rotary brushes.

3 Claims, 2 Drawing Figures

MACHINE FOR BURRING AND CLEANING OF SUBSTANTIALLY PLANE WORK PIECES

Figure 1:
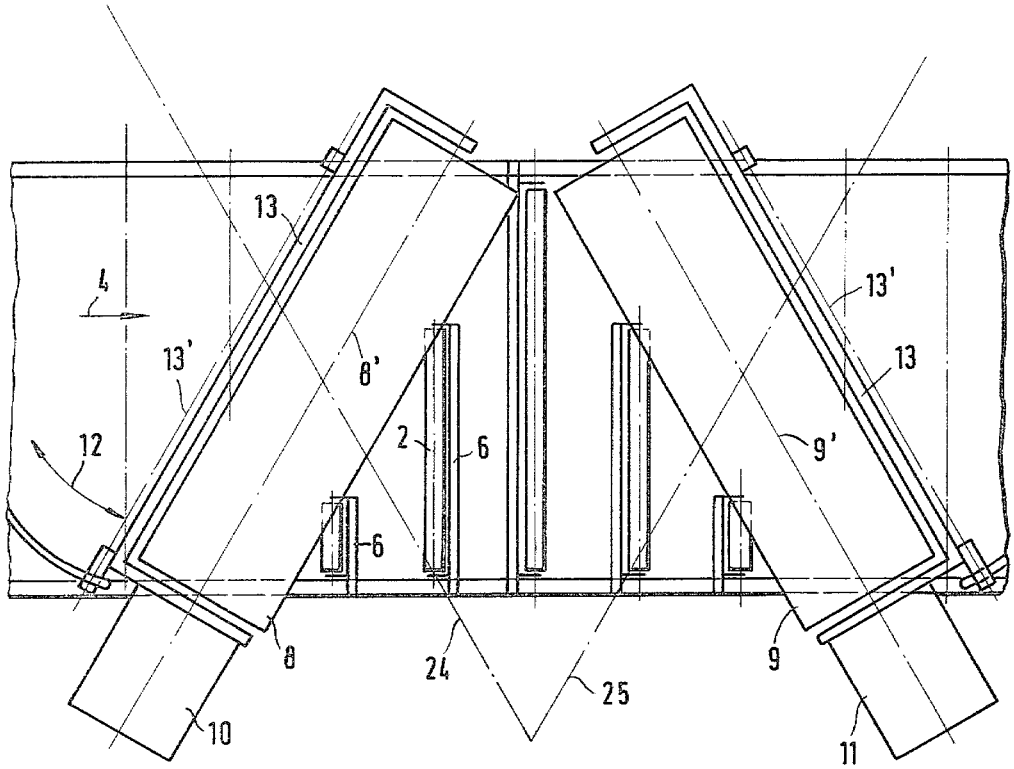

This invention relates to a machine for burring and cleaning of substantially plane work pieces such as metal sheets having arbitrarily formed contours, openings and/or apertures;, comprising a conveying means which is preferably constituted of a plurality of conveying rollers and at least one driven rotary brush on each side of the path of the work pieces for a brushing of their both surfaces substantially at the same time.

In known machines of this kind there are provided in general a plurality of rotary brushes as arranged in pairs and with the horizontal axis of rotation crosswise in respect to the conveying direction of the work pieces. All of the rotary brushes arranged at one side of the work pieces are driven either in the same rotary direction or partly in an opposite rotary direction whereby the rotary direction of each upper rotary brush of a pair of rotary brushes is opposite to the rotary direction of the respective lower rotary brush. The rotary brushes are each equipped with a plurality of rows of brushes which are arranged on the roller drum along spiral circumferential lines so that with an arrangement of the two rotary brushes of each pair with their horizontal axis of rotation shifted in parallel in the conveying direction of the work pieces the bristles of the upper and the lower rotary brushes will contact each other at their tips in a mutually overlapping fashion. The brushes are all constituted of bunches as radially arranged in respect to the axis of rotation of the respective rotary brush so that all of these bunches provide the same angle of incidence in respect to the surfaces of the work pieces which accordingly are only brushed along lines extending in parallel to the conveying direction.

The effect of the cleaning as obtained by such conventional rotary brushes therefore directly depends on the closeness with which such bunches of brushes are arranged on the surface of the roller drum whereas the effect of the burring operation depends on the orientation of the edges which are to be burred in respect to the beforementioned angle of incidence. An optimum burring operation will accordingly be obtained only for such edges of the work pieces which are oriented with a right angle in respect to the conveying direction whereas all other edges such as especially edges extending in parallel to the conveying direction of the work pieces are highly incompletely worked so that for avoiding such respective shortcomings it will be necessary to have such work pieces repeatedly brushed at least in one further passage through the rotary brushes with a different relative position of the work pieces for thusly obtaining an improved burring also for such other edges. When causing such a plurality of passages of the work pieces through the rotary brushes this will of course raise the processing costs whereby the improvement which is aimed by such a plurality of passages may even not be at an optimum in the case of an irregular orientation of the edges and especially in the case of round openings as for example produced by a punching operation in metal sheets.

It is an o;bject of this invention to provide a machine for burring and cleaning of substantially plane work pieces which will allow these operations to be carried out with only a single passage whereby it is especially thought of the processing of thin metal sheets having arbitrarily formed contours, openings and/or apertures as produced by a punching or any other cutting operation. In accordance with this invention a machine for burring and cleaning of substantially plane work pieces of the kind as discussed before is therefore provided with a pair of rotary brushes that are arranged with their horizontal axis of rotation at a corresponding inclination with respect to the conveying direction of the work pieces, the rotary brushes being equipped with twisted or tressed bristles which with a corresponding distance of the horizontal axis of rotation of the two rotary brushes are meshing in the manner of interengaging gears.

The arrangement of the two rotary brushes at a corresponding inclination with respect to the conveying direction of the work pileces results in a change of the angle of incidence of the twisted or tressed bristles which due to this twist or tress of the bristles effect the removal of the burrs as a smooth chip peeling action. This particular chip peeling actlion takes place without causing any changes of the dimensions of the edges to be burred so that these edges will especially not receive any chamfers or other markings which is due to the fact that the bristles meshing in the manner of interengaging gears are safely guilding the work pieces during their passage through the gap between the upper and the lower rotary brushes avoiding thereby any evading movement of the bristles when they contact the surfaces of the work pieces.

Figure 2:
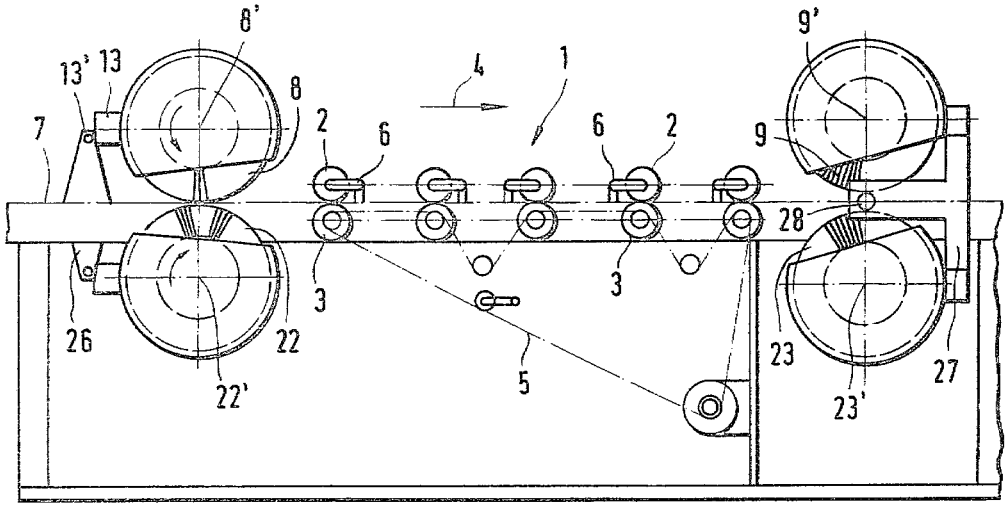

Other objects and advantages of the invention will be apparent from the following description of an embodiment of the invention as illustrated in the accompanying drawings, wherein FIG. 1 is a plane view of the machine and FIG. 2 is a side-view of this machine.

The machine for burring and cleaning of substantially plane work pieces comprises a conveying means 1 constituted of pairwise arranged upper and lower conveying rollers 2 and 3 for causing a conveying direction for the work pieces in the sense of the arrow 4. The upper conveying rollers 2 are provided with a trailing drive through the lower conveying rollers 3 which are driven by a common chain drive 5. Each upper conveying roller 2 is arranged on a pivoted frame 6 which is biased towards the coordinated lower conveying roller 3 by any suitable elastic means (not shown). There is accordingly provided a conveying clearance between the upper and lower conveying rollers 2 and 3 of each pair of rollers which is designed in a "breathing" manner allowing the transport of the work pieces as laid on the working table 7 of of the machine fully automatically in the defined conveying direction as soon as the work pieces are drawn into the clearance of the first pair of conveying rollers arranged at the beginning of the conveying path. It is well understood that the working table 7 is provided with an opening at the position of each lower conveying roller 3 so that the same may contact its adjacent upper conveying roller 2. The lower conveying rollers 3 will slightly protrude over the surface of the working table 7 to thereby assure a safe contact with the lower surface of the work pieces when the same are laid flatly on the working table. It should be well understood, that the conveying means 1 is shown rather incompletely for the purposes of a clear presentation so that particularly the upper and lower conveying rollers are missing which are arranged at the beginning and at the end of the conveying path.

The machine further comprises two rotary brushes 8 and 9 which are arranged above the conveying path of the work pieces and which are equipped with twisted or tressed bristles. The rotary brushes 8 and 9 are arranged with their horizontal axis of rotation 8' and 9' at an inclination with respect to the conveying direction 4 of the work pieces and they are individually driven by means of a flanged-on motor 10 and 11, respectively. The inclination of the one rotary brush 8 with respect to the conveying direction 4 is chosen with an angle of about 60° whereas the inclination of the other rotary brush 9 is symmetrical to the rotary brush 8 so that the same angle only towards the other side is also present with this ohter rotary brush. The inclination of both rotary brushes 8 and 9 may be adjusted to different angles as indicated by the arrow 12 for the one rotary brush 8 whereby this paticular adjustability will allow to take advantage of the entire length of the rotary brushes 8 and 9 also for work pieces which are not provided with the full width of the working table 7. When adjusting the inclination of the rotary brushes between angles of about 30° and 60° in respect to the conveying direction 4 of the work pieces this will then allow that with an angle of 30° the full width of the working table 7 will be bridged by the entire length of the rotary brushes 8 and 9 whereas with an angle of 60° only about half of the width of the working table 7 will be bridged with the same entire length of the rotary brushes 8 and 9. In thusly changing the inclination of the rotary brushes 8 and 9 any irregular wear of the twisted or tressed bristles will therefore be avoided whereby this particular adjustability is further chosen under the consideration of reaching optimum conditions under any specific aspect of the work pieces.

The rotary brushes 8 and 9 are each arranged on a rocker or oscillation means 13 having a pivot axis in parallel to the axis of rotation 8' and 9', respectively, of the two rotary brushes. Each rocker or oscillation means 13 is adjustably supported in a manner also not shown in detail to thereby allow the rotary brushes 8 and 9 to be adjusted with their twisted or tressed bristles to any desired distance from the upper side of the working table 7 or rather from the upper surface of the work pieces to be burred and cleaned with this machine. The particular support of the rocker or oscillation means 13 may also comprise a biasing means (not shown) to thereby allow an automatic adaption to varying thicknesses of the work pieces. The rocker or oscillation means may also be designed as suction channels to thereby allow in combination with any suitable suction pump the removal of the dust which is produced during the brushing action of the rotary brushes. In this case such suction channels would partly cover the coordinated rotary brush and would then be arranged as forming an oscillating interconnection between the respective pivot axis 13' and the axis of rotation 8' and 9', respectively, of the coordinated rotary brush.

The machine further comprises lower rotary brushes 22 and 23 which are also equipped with twisted or tressed bristles meshing with the bristles of the corresponding upper rotary brushes 8 and 9 in the manner of interengaging gears. The pairs of rotary brushes 8, 22 and 9, 23, respectively, are arranged with their respective axis of rotation either in a common vertical plane or in vertical planes shifted in parallel whereby for the purpose of allowing the interengagement of the bristles the working table 7 is provided at the position of these rotary brushes with similar but larger openings as they are provided for the lower conveying rollers 3 for the above explained reason. The openings which are provided for the lower rotary brushes 22 and 23 must be provided with such a size as to allow the adjustability of the inclination within any given limits. One of the lower rotary brushes 22 and 23 may also be arranged at an inclination with respect to the conveying direction 4 as crossed to the inclination of the upper rotary brushes 8 and 9 which is indicated by the dotted lines 24 and 25. The lower rotary brushes 22 and 23 are also arranged on rocker or oscillation means 26 having each a pivot axis in parallel to the axis of rotation 22' and 23', respectively, of the coordinated rotary brush. The two rocker or oscillation means 13 and 26 of a pair of rotary brushes as arranged in a common vertical plane or in vertical planes shifted in parallel may also be designed as a double rocker or oscillation means 27 having a single pivot axis 28 as shown in FIG. 2 for the two rotary brushes 9 and 23.

What is claimed is:

1. A machine for burring and cleaning of substantially plane work pieces having arbitrarily formed contours, openings and apertures comprising conveying means defining a substantially horizontal conveying direction for said work pieces and at least one upper rotary brush and one lower rotary brush, said brushes mounted on axes of rotation which are parallel in a substantially common vertical plane and spaced so as to engage opposed upper and lower surfaces of said work pieces and said brushes having groupings of bristles alternating with spacings along the radial direction of said brushes, said groupings of bristles of said upper brush being received between said spacings of said lower brush defining an interlocking gear arrangement except when prevented by said work pieces.

2. The machine according to claim 1 in which each rotary brush is adjustably supported by rocker means having a pivot axis in paralled to said axis of rotation of each rotary brush.

3. The machine according to claim 2 in which said rocker means forms an oscillating interconnection between said pivot axis and said axis of rotation of each rotary brush.

* * * * *